United States Patent [19]

Hegle

[11] Patent Number: 4,512,685

[45] Date of Patent: Apr. 23, 1985

[54] MORTARLESS RETAINING-WALL SYSTEM AND COMPONENTS THEREOF

[75] Inventor: Richard L. Hegle, Honolulu

[73] Assignee: Ameron, Inc., Monterey Park, Calif.

[21] Appl. No.: 300,308

[22] Filed: Sep. 8, 1981

[51] Int. Cl.[3] ..... E02D 17/20

[52] U.S. Cl. ..... 405/284; 52/586; 52/609; 405/258; 405/285

[58] Field of Search ..... 405/272, 273, 284, 285, 405/286; 52/590, 591, 594, 586, 609, 608

[56] References Cited

U.S. PATENT DOCUMENTS

| | | | |
|---|---|---|---|
| 903,906 | 11/1908 | Soss | 52/594 |
| 3,210,944 | 10/1965 | Svee . | |
| 3,229,439 | 1/1966 | Strobel | 52/594 X |
| 3,379,017 | 4/1968 | Kusatake | 52/594 X |
| 3,435,576 | 4/1969 | Giannelia | 52/594 X |
| 4,035,975 | 7/1977 | Gergely | 52/591 X |
| 4,041,660 | 8/1977 | Yensen | 52/590 X |
| 4,081,969 | 4/1978 | Clarke . | |
| 4,132,498 | 1/1979 | Ikeda et al. | 405/284 |
| 4,190,384 | 2/1980 | Neumann . | |
| 4,193,718 | 3/1980 | Wahrendorf et al. . | |
| 4,269,545 | 5/1981 | Finney | 405/284 |

FOREIGN PATENT DOCUMENTS

| | | | |
|---|---|---|---|
| 404479 | 1/1967 | Australia | 405/273 |
| 494512 | 5/1930 | Fed. Rep. of Germany | 405/284 |

OTHER PUBLICATIONS

Copy of two-page brochure of Prefab Systems International pertaining to Earthstone.

*Primary Examiner*—Dennis L. Taylor
*Attorney, Agent, or Firm*—Christie, Parker & Hale

[57] ABSTRACT

A building block made of concrete or the like comprises a front face, a back face, a top face, a bottom face, and a pair of side faces. The top face has a convex angular first surface with a vertex extending between the side faces, and a concave angular second surface with a vertex extending between the side faces. The concave second surface lies between the convex first surface and the front face of the block. The bottom face has a concave angular third surface with a vertex extending between the side faces, and a convex angular fourth surface with a vertex extending between the side faces. The convex fourth surface lies between the concave third surface and the front face. The convexity of the first and fourth surfaces matches the concavity of the third and second surfaces, respectively, thereby forming a double interlock, namely, an interlock between the first and third surfaces and an interlock between the second and fourth surfaces. A mortarless retaining-wall system is made from the described blocks stacked one on top of the other to form a plurality of upright spaced-apart columns and a plurality of stacked beams extending between each pair of adjacent columns. The ends of the beams are held between the respective blocks of the columns.

28 Claims, 17 Drawing Figures

FIG. 1
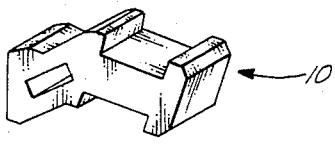
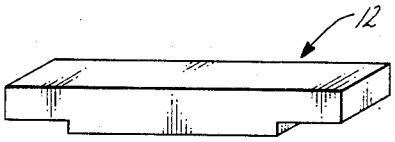
FIG. 2
FIG. 3A
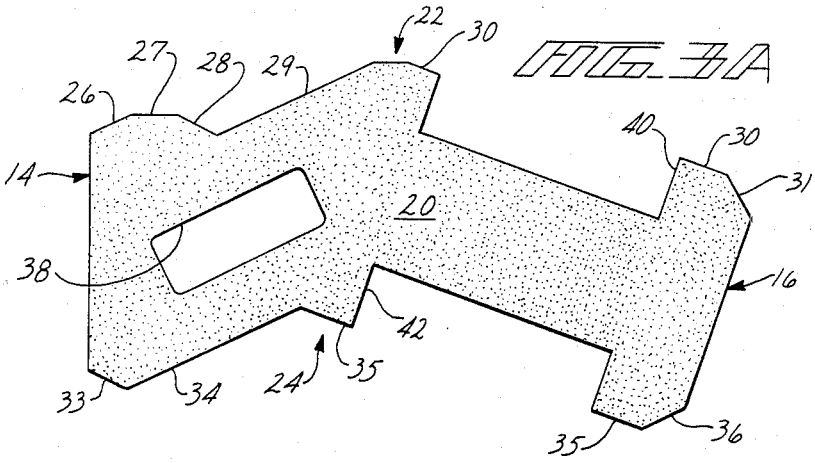
FIG. 3B
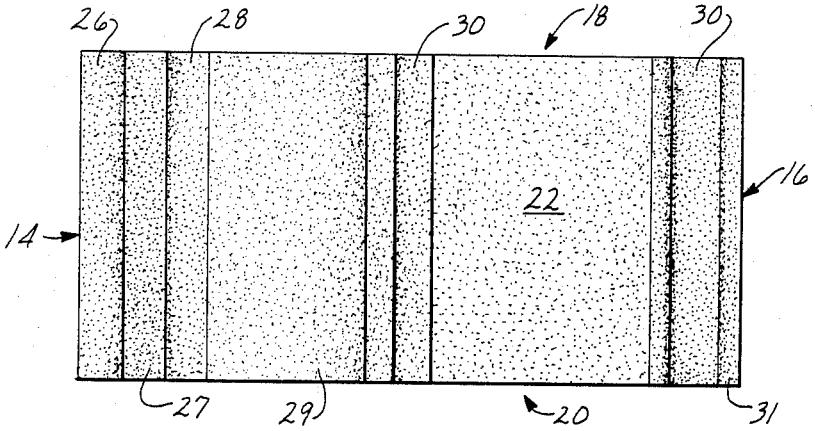

FIG. 4-A
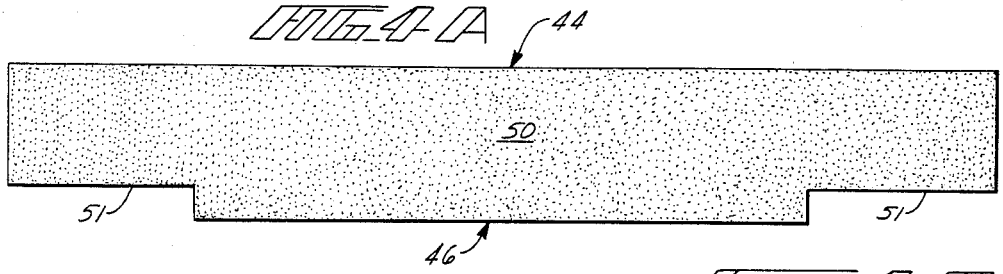
FIG. 4-B
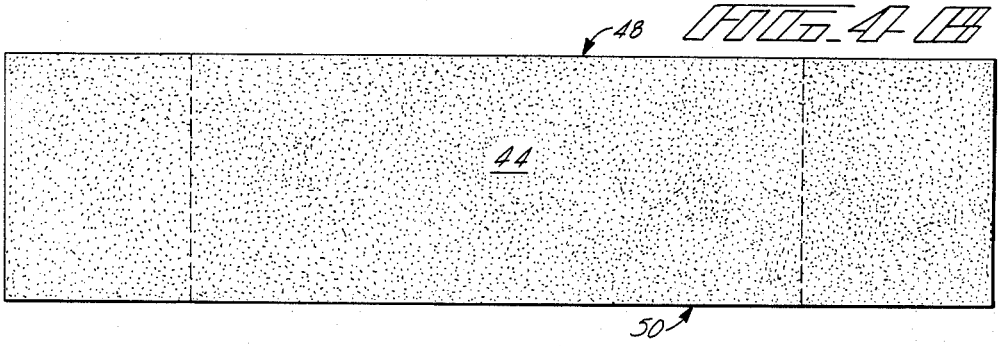
FIG. 5
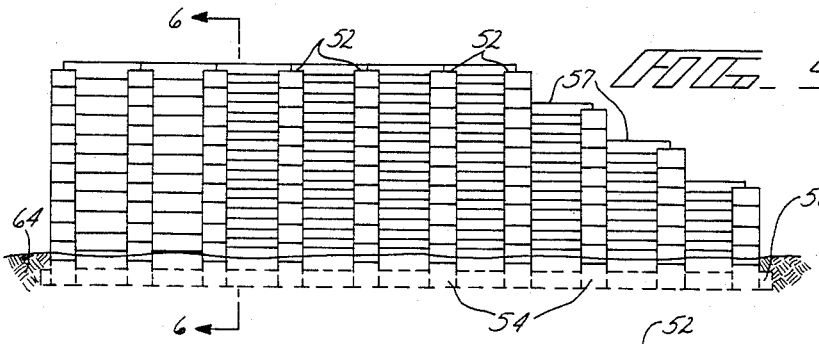
FIG. 6
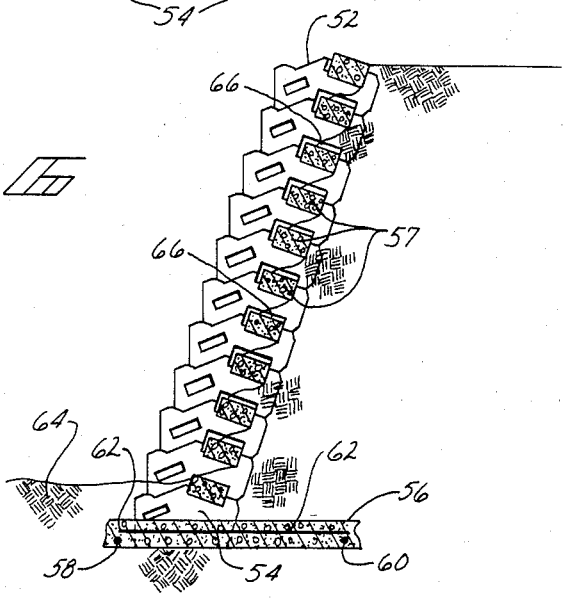

MORTARLESS RETAINING-WALL SYSTEM AND COMPONENTS THEREOF

BACKGROUND OF THE INVENTION

This invention relates to concrete products and, more particularly, to a mortarless retaining-wall system and components thereof.

Retaining walls that can be built without the use of mortar require a smaller expenditure of labor and time to construct than those utilizing mortar to hold the components in place. Generally, the price paid for mortarless construction is a reduction in the allowable height of the retaining wall. Wahrendorf et al Pat. No. 4,193,718 discloses a retaining wall constructed from stacked, alternately staggered rows of spaced, nesting, chevron-shaped concrete blocks. The top face of each block has a convex angular surface with a vertex extending between the side faces of the block, and its bottom face has a concave angular surface with a vertex extending between the side faces of the block. The convexity of the top face matches the concavity of the bottom face, so that the blocks can be stacked on top of each other in interlocking fashion. Despite the interlocking action between blocks, when a high retaining wall is built, the horizontal force exerted on the top of the wall by the retained soil tends to cause the upper blocks to slide relative to the blocks beneath them, thereby limiting the allowable height of the wall.

SUMMARY OF THE INVENTION

According to one aspect of the invention, retaining-wall building blocks are provided with a double interlock between the top face of one block and the bottom face of the overlying block. This double interlock more effectively inhibits slippage between blocks, and thereby increases the allowable wall height. Specifically, a building block made of concrete or the like comprises a front face, a back face, a top face, a bottom face, and a pair of side faces. The top face has a convex angular first surface with a vertex extending between the side faces, and a concave angular second surface with a vertex extending between the side faces. The concave second surface lies between the convex first surface and the front face of the block. The bottom face has a concave angular third surface with a vertex extending between the side faces, and a convex angular fourth surface with a vertex extending between the side faces. The convex fourth surface lies between the concave third surface and the front face. The convexity of the first and fourth surfaces matches the concavity of the third and second surfaces, respectively, thereby forming a double interlock, namely, an interlock between the first and third surfaces and an interlock between the second and fourth surfaces.

According to another aspect of the invention, a mortarless retaining-wall system made of concrete or the like comprises a plurality of upright, spaced-apart columns each formed by a plurality of blocks stacked one on top of the other and a plurality of stacked horizontal beams extending between each pair of adjacent columns. The ends of the beams are held between the respective blocks of the columns.

One feature of such a system is blocks each having a recessed top and a recessed bottom, so arranged to form beam-receiving cavities between top and bottom of abutting blocks. The ends of the beams lie in the respective cavities to form an interlock between the blocks and the beams.

Another feature of such a system comprises beams that are stepped back and spaced apart from each other a distance such that the angle formed by a plane from the lower back edge of one beam to the upper front edge of the underlying beam with the horizontal is smaller than the angle of repose of the retained ground. This permits a material saving to be realized in that the beams need not be abutting to perform a soil-retaining function. Preferably, the beams each have approximately parallel top and bottom faces oriented non-horizontally, and approximately parallel front and back faces oriented so that the front faces of all the beams between adjacent columns lie approximately in the same plane, and the back faces of all the beams between adjacent columns lie approximately in the same plane. The non-horizontal orientation permits the beams to be spaced further apart without losing the ability to retain the soil.

Another feature of such a system comprises blocks having top and bottom faces contoured in complementary fashion so the abutting blocks forming each column are interlocked.

Still another feature of such a system comprises beams having stepped ends and beam-receiving cavities having a given depth formed in the blocks. A portion of the stepped ends of the beams lies in the respective cavities. The stepped ends of the beams have a height less than the given depth, and the remainder of the beams have a height greater than the given depth. This permits the load-carrying portions of the beams to have a larger cross-section than the cavities formed in the blocks, so the structural integrity of the blocks is maintained. Preferably, the stepped ends of the beams are longer than one-half the distance between the side faces of each block.

Yet another feature of such a system is beam-receiving cavities that are formed in the blocks such that the top and bottom of the beams are both spaced from the abutting top and bottom faces of the blocks, thereby preventing slippage between the blocks and beams.

BRIEF DESCRIPTION OF THE DRAWINGS

The features of specific embodiments of the best mode contemplated of carrying out the invention are illustrated in the drawings, in which:

FIG. 1 is a perspective view of a block incorporating principles of the invention;

FIG. 2 is a perspective view of a beam incorporating principles of the invention;

FIGS. 3A and 3B are side elevation and top plan views, respectively, of the block of FIG. 1;

FIGS. 4A and 4B are side elevation and top plan views, respectively, of the beam of FIG. 2;

FIG. 5 is a front view of a retaining-wall system built from blocks and beams of the type shown in FIGS. 1 through 4;

FIG. 6 is a side-sectional view of the retaining-wall system of FIG. 5 taken through plane 6—6;

DETAILED DESCRIPTION OF THE SPECIFIC EMBODIMENTS

Figure 8:
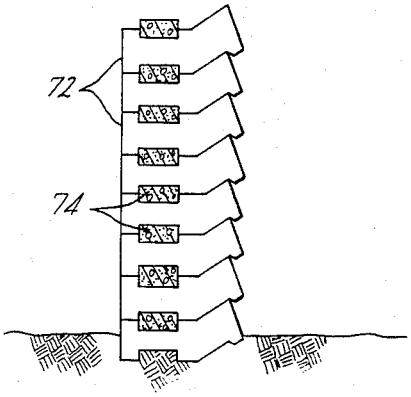
FIG. 8 is a side-sectional view of a wall system built from blocks and beams of the type shown in FIGS. 1 through 4 in which the blocks are stacked differently from the systems of FIGS. 6 and 7.

In FIGS. 1 and 2, a block 10 and a beam 12, respectively, comprise the components of a mortarless retaining-wall system. Such a system can be built from blocks alone or from the blocks and beams together. The blocks and beams are precast, i.e., cast before arrival at the building site, from concrete or the like, i.e., a building material similar to concrete or a suitable substitute for concrete.

Reference is made to FIGS. 3A and 3B for a detailed description of block 10, which has a front face 14, a back face 16, side faces 18 and 20, a top face 22, and a bottom face 24. (The terms "front," "back," "top" and "bottom" are used for convenience; as illustrated herein, use of these terms does not preclude other orientations of the blocks.) Front face 14 and back face 16 are planar and non-parallel, converging downwardly toward each other. Side faces 18 and 20 are planar and approximately parallel to each other. Top face 22 and bottom face 24 are contoured to provide a double interlock when vertically stacked in abutment with similar blocks. Specifically, the contour of top face 22 is formed by a number of planar surfaces, all of which are transverse, and, preferably, approximately perpendicular, to side faces 18 and 20; moving from front face 14 to back face 16, these surfaces are as follows: a bevel surface 26, a ledge-forming surface 27, a front surface 28, a medial surface 29, a back surface 30, and a bevel surface 31. Front surface 28 and medial surface 29 together form a concave angular surface with a vertex extending between side faces 18 and 20. Medial surface 29 and back surface 30 together form a convex angular surface with a vertex extending between side faces 18 and 20. If desired, the vertex of this convex angular surface could be beveled slightly as shown to inhibit damage to the block. Ledge-forming surface 27 is approximately perpendicular to front face 14.

The contour of bottom face 24 is formed by a number of planar surfaces, all of which are transverse, and, preferably, approximately perpendicular, to side faces 18 and 20; moving from front face 14 to back face 16 these surfaces are as follows: a front surface 33, a medial surface 34, a back surface 35, and a bevel surface 36. Bevel surfaces 26, 31 and 36 inhibit damage to the block. Each pair of front surfaces 28 and 33, medial surfaces 29 and 34, and back surfaces 30 and 35 are parallel to each other.

Front surface 33 and medial surface 34 together form a convex angular surface with a vertex extending between side faces 18 and 20. Medial surface 34 and back surface 35 together form a concave angular surface with a vertex extending between side faces 18 and 20. The convex angular surface of top face 22 matches the concave angular surface of bottom face 24, and the convex angular surface of bottom face 24 matches the concave angular surface of top face 22, thereby forming a double interlocking contour when the blocks are stacked vertically one on top of the other. Stated differently, the top and bottom faces of a block each have a shallow Z-shape. Since the surfaces forming these faces of the block are parallel to each other, the block itself has a shallow Z-shape. When adjacent blocks are stacked with top and bottom faces in engagement, the interlocking of the Z-shapes prevents shifting toward the front face or towards the back face. This can be compared with blocks in the aforementioned Wahrendorf Pat. No. 4,193,718, where the top and bottom faces of each block are each shallowly V-shaped. When adjacent blocks are stacked, the inner faces near the earth-retaining side of a wall may be in tight engagement, for example. The outer faces can readily be spaced apart a small distance as the upper block is shifted forwardly relative to the lower block. When such shifting occurs at each course in a wall, the wall can become too steep. Such forward shifting of the Z-shaped blocks is prevented by engagement of the front surface 33 on the bottom face of one block with the front surface 28 on the top face of the next lower block.

Although the inclinations of the front surface 28 and the back surface 30 on the top face (and the corresponding surfaces 33 and 35 on the bottom face) are approximately the same, it will be noted that the front surface is more steeply inclined than the back surface by a small angle, in the preferred embodiment about 7°. Thus, the front and back surfaces converge slightly toward the front face of the block. Stated differently, the included concave angle between the front surface 28 and the medial surface 29 is smaller than the included convex angle between the medial surface 29 and the back surface 30. There is correspondence to this in the angular relations on the bottom face of the block to permit snug matching of the faces. This convergence keeps an upper block in a stack from shifting forwardly relative to a lower block leaving a small gap between the medial surfaces 29 and 34 as could inadvertently occur if the front and back surfaces were parallel. The four angles formed by faces 22 and 24 are all obtuse, approximately the same, and preferably between 130° and 140°.

In the preferred embodiment, front surface 28 forms an angle of about 295° with front face 14, medial surface 29 forms an angle of about 245° with front face 14, and back surface 30 forms an angle of about 288° with front face 14. Similarly, in the preferred enbodiment, front surface 33 forms an angle of about 245° with front face 14, medial surface 34 forms an angle of about 295° with front face 14, and back surface 35 forms an angle of about 252° with front face 14. In the preferred embodiment, the convex surface of top face 22 and the concave surface of face 24 form an angle of about 137°, and the concave surface of top face 22 and the convex surface of bottom face 24 form an angle of about 130°.

As used herein, the term "matching angular surfaces" means surfaces forming approximately the same angle and fitting together sufficiently snuggly to inhibit sliding. Such sliding is prevented toward the back or front of the blocks. The vertexes extend between the sides of the blocks so that the blocks can be stacked directly atop one another or overlapped in successive courses.

An optional cavity 38 is preferably formed in the block from side to side between side faces 18 and 20 near front face 14. Cavity 38 has a rectangular cross-section; its top and bottom surfaces are parallel to medial surfaces 29 and 34, and lie partially therebetween so as to permit those handling the blocks to grip them between the medial surfaces and the top and bottom surfaces of cavity 38. The presence of cavity 38 also reduces the quantity of building material required and, thus, the weight and cost per block.

In a block designed to be used with beams to build a retaining-wall system, optional recesses 40 and 42 are formed in top face 22 and bottom face 24, respectively. Recesses 40 and 42 extend from side to side between side faces 18 and 20 within back surfaces 30 and 35, respectively. Recesses 40 and 42 have rectangular cross-sections and side walls that are aligned with each other and approximately perpendicular to back surfaces 30 and 35, thereby forming beam-receiving cavities with similar recesses of abutting, vertically stacked blocks. The depth of the beam-receiving cavities is twice the side wall depth of the recesses (40 and 42). If a retaining wall is built from blocks only, recesses 40 and 42 could be eliminated.

Reference is made to FIGS. 4A and 4B for a detailed description of beam 12, which has a top face 44, a bottom face 46, and side faces 48 and 50. Top face 44 and bottom face 46 are approximately parallel to each other and side faces 48 and 50 are approximately parallel to each other, the cross-section of the beam being rectangular. The height of side faces 48 and 50 in the middle of the beam is greater than at the ends of the beam, thereby forming steps 51 in bottom face 46 at the ends of the beam. The height of the stepped beam ends is slightly less than the depth of the beam receiving cavities formed by the vertically stacked blocks, and the height of the beam in the middle is greater than the depth of the beam-receiving cavities. This permits the load-carrying portions of the beams to have a larger cross-section than the cavities formed in the blocks, so the structural integrity of the blocks is maintained.

In FIGS. 5 and 6 is shown a mortarless retaining-wall system built from the described blocks and beams. Upright spaced-apart columns 52 are formed by a plurality of the described blocks stacked one on top of the other. The base block of each of columns 52, designated 54 in FIG. 6, is modified to have a planar bottom face approximately perpendicular to the front face thereof so as to permit it to rest squarely on a horizontal surface. Base blocks 54 are set in a concrete footing 56, which extends the full length of the retaining wall, as illustrated in FIG. 6. Reinforcing bars 58, 60 and 62 are embedded in footing 56. Reinforcing bars 56 and 58 extend along the entire length of the front and back of the retaining wall, respectively, and reinforcing bars 62 extend transverse to reinforcing bars 58 and 60 midway between columns 52. After reinforcing bars 58, 60 and 62 are laid, footing 56 is cast in place on the building site. Footing 56, base blocks 54, and if desired, all or part of one or more other blocks of each of columns 52, lie below grade level designated at 64. As illustrated in FIG. 6, when the blocks are stacked one on top of the other their front faces are approximately vertical each one being stepped back from the underlying block toward the retained soil. The back faces of the blocks are all aligned in a single sloping plane. The double interlock between abutting blocks inhibits each block from slipping away from the retained soil relative to the underlying block. Specifically, when a block tends to slip, the front surface of its bottom face (33) bears against the front surface of the top face of the underlying block (28) and slippage is thus inhibited. A plurality of stacked beams 57 of the described type extend between each pair of adjacent columns 52. The ends of the beams lie in the cavities formed by abutting blocks, except for base blocks 54, as depicted in FIG. 6. (The cavities are exaggerated relative to the beams in FIG. 6 to show the fitting of the steps into the cavities. A tighter fit than suggested by the drawing is used for strength.) Since a portion of the cavities is formed by each block, the beams interlock at each end with both abutting blocks, thereby increasing the loadbearing capacity of the system. It should be noted that by virtue of the orientation of the beam-receiving cavities, the front faces of the beams are slanted and in alignment with each other. Thus, the top and bottom faces of the beams are oriented non-horizontally, and the front and back faces thereof are oriented so the front faces of all the beams between adjacent columns lie approximately in the same plane, and the back faces of all the beams between adjacent columns lie approximately in the same plane.

In the construction of the described retaining wall system, a trench is first excavated for the foundation. Then, base blocks 54 are set in place in the trench at the proper center-to-center spacing which for a straight wall, is equal to the length of the beams plus a small tolerance factor. Reinforcing bars 58, 60 and 62 are set in place and footing 56 is poured. Next, the second course of blocks is set on top of base blocks 54 and the trench is filled in to grade level. Then, the first course of beams 57 is set in place with the ends of the beams lying in the recesses in the top of the second course of blocks. The third course of blocks is then set in place with the second course of beams fitting in its bottom recesses to interlock the second course of beams with the second course of blocks and the first course of blocks. Thereafter, courses of blocks and beams are alternately set in place until the desired height is reached. After every course of several courses, the space behind the wall is backfilled with soil to be retained. To increase the allowable height of the wall, the blocks and beams are slanted more toward the retained soil such as by tilting the base blocks 54.

The height of the beams can be such that the top and bottom faces of adjacent beams abut each other, as shown on the left side of FIG. 5, or such that the top and bottom faces of adjacent beams are spaced from each other, as shown on the right side of FIG. 5, thereby forming slits between adjacent beams. In order to prevent soil from passing through the slits in the latter case, adjacent beams must be sufficiently close together, taking into account their cross-sectional width and slant angle, so that the angle formed by an imaginary plane from the back bottom edge of one beam to the front top edge of the underlying beam with the horizontal is smaller than the angle of repose of the retained soil. In such case, as illustrated in FIG. 6, the soil between adjacent beams, designated 66, which assumes the angle of repose, does not reach the top front edge of the beams and, therefore, does not flow through the slits. It should be noted that slanting the beams as shown in FIG. 6 decreases the vertical distance between the bottom back edge of one block and the front top edge of the underlying block, thereby permitting use of beams of lesser height without flow of the retained soil through the slits therebetween. If desired, the blocks and beams at the top of the retaining wall could be secured by concrete adhesive to prevent malicious dismantling of the wall. The top of the wall could be squared off, as shown on the left side of FIG. 5, or stepped, as shown on the right side of FIG. 5, depending on the nature of the grade behind the wall.

Figure 7:
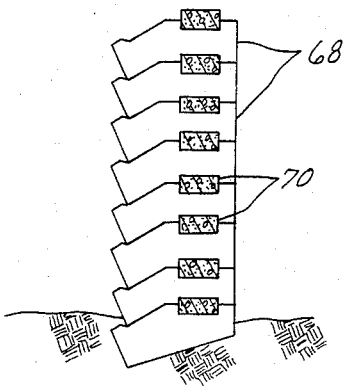
FIG. 7 is a side-sectional view of a wall system built from blocks and beams of the type shown in FIGS. 1 through 4 in which the blocks are stacked differently from the system shown in FIG. 6.

FIG. 7 depicts a retaining or free-standing wall system in which the blocks designated 68 are tilted so that their back faces are aligned with a vertical plane, and the beams designated 70 are vertically aligned one on top of the other. This component arrangement is established by setting the base blocks down with their bottom faces tilting forward, rather than being horizontal.

FIG. 8 depicts a retaining or free-standing wall system in which the blocks designated 72 are set upside down. The back faces of the blocks are aligned with a vertical plane, and the beams designated 74 are vertically aligned one on top of the other. This component arrangement is established by setting the base blocks down with the back surface (30) of the top face (22) in a horizontal position. The systems shown in FIGS. 7 and 8 do not retain soil as well as the system of FIGS. 5 and 6, but when constructed to a moderate height can function well as a free-standing wall.

Figure 9:
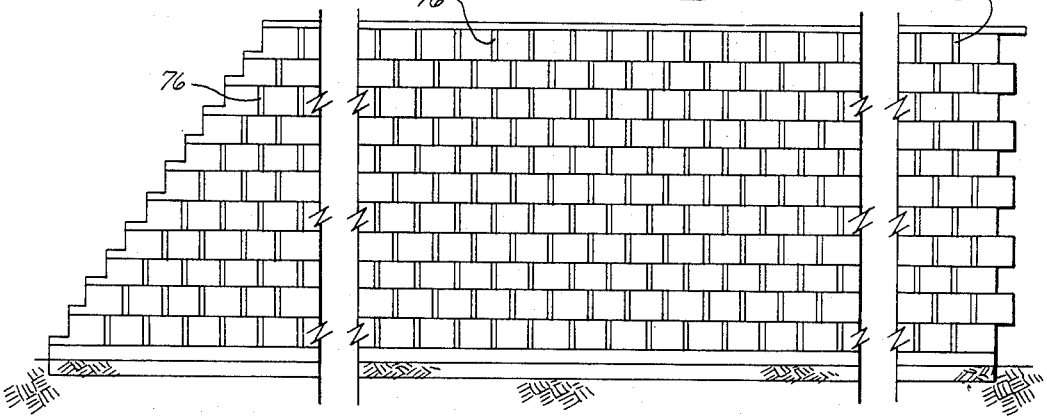
FIG. 9 is a front elevation view of a retaining-wall system built only from blocks of the type shown in FIGS. 1 and 3.

In FIG. 9 is shown a retaining-wall system built only from the described blocks. As illustrated, the blocks of each course are staggered relative to the blocks of the course above and below. Adjacent blocks in a course are spaced a small distance from each other to form gaps, such as that designated 76, for drainage of water through the wall. In similar fashion, a wall can be constructed only from blocks set down in the manner illustrated in FIGS. 7 and 8.

Figure 10:
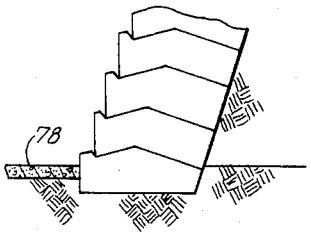
FIGS. 10 through 13 are side-sectional views of part of a retaining-wall system showing different techniques for anchoring the foundation.
Figure 11:
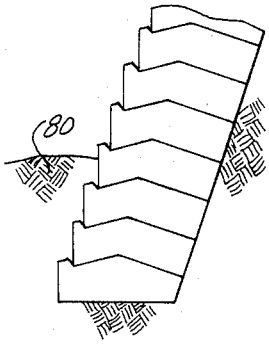
Figure 12:
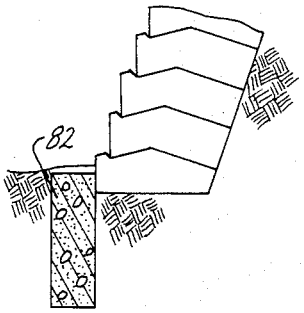
Figure 13:
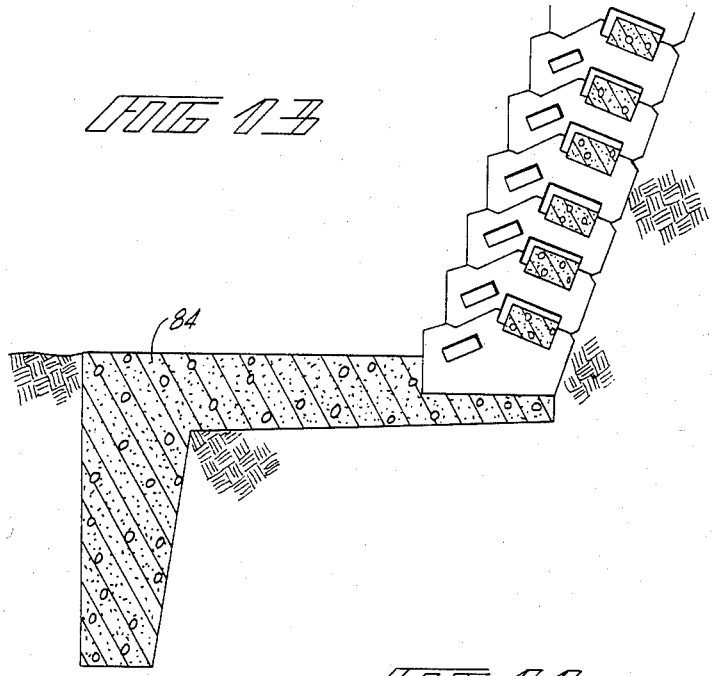

FIGS. 10 through 13 illustrate alternative foundations for the described retaining-wall systems. In FIG. 10, one end of a precast or cast-in-place concrete horizontal slab 78 abuts the front face of the base blocks. The friction between slab 78 and the underlying soil resists horizontal movement of the wall away from the retained soil. In FIG. 11, soil 80 abuts the front face of the base blocks and the blocks of several courses above the base blocks, which are below grade level, to resist sliding of the wall away from the retained soil. In FIG. 12, a precast or cast-in-place concrete vertical column 82 is embedded in the soil in front of the retaining wall. The top of column 82 abuts the front face of the base blocks. The passive soil resistance against column 82 holds the wall in place. In FIG. 13, an L-shaped footing 84 is cast in place in front of the retaining wall. Footing 84 has a horizontal leg and a vertical leg embedded in the soil. The end of the horizontal leg is cast around the base block of the wall, and the vertical leg extends downwardly into the soil from grade level or below. The horizontal and vertical legs resist movement of the wall away from the retained soil in a similar fashion to the foundation of FIG. 10 and the foundation of FIG. 12, respectively.

Figure 14:
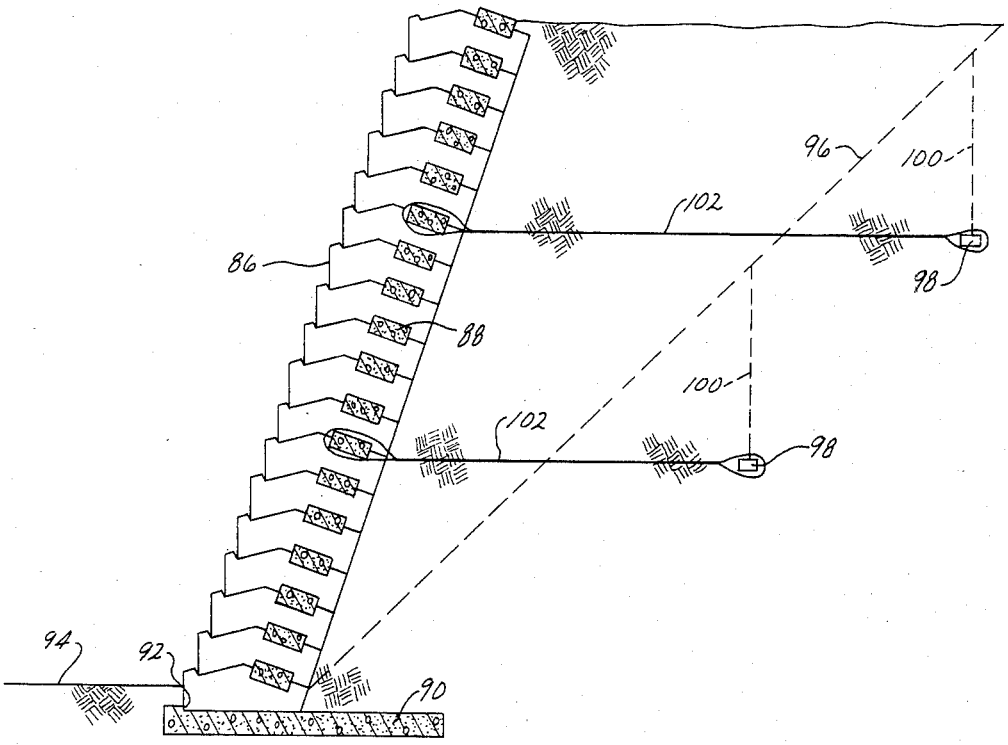
FIG. 14 is a side-sectional view of a retaining-wall system built from blocks and beams of the type shown in FIGS. 1 through 4 with anchoring means above the foundation.

In FIG. 14, a retaining wall built from blocks designated 86 and beams designated 88 is supported by a horizontal foundational slab 90. Slab 90 has a front lip 92 against which the front face of the base block bears. Slab 90 and most of the base blocks lie beneath grade level designated 94. Behind the wall, the angle of repose of the soil is designated 96. To the right of the angle of repose, as viewed in FIG. 14, is stable, i.e., non-fill soil, and between the angle of repose and the wall is backfilled soil. Several courses of the wall are anchored in stable earth. Specifically, beams, rods or rails 98, preferably running parallel to beams 88, are embedded in the stable earth by excavating from above, as depicted by dashed lines 100, prior to placement of the backfilled soil. Tie-back cables 102 are looped around beams 88 and 98 and extend therebetween to transfer horizontal forces exerted on the wall to the stable soil, thereby increasing the allowable height of the wall.

Figure 15:
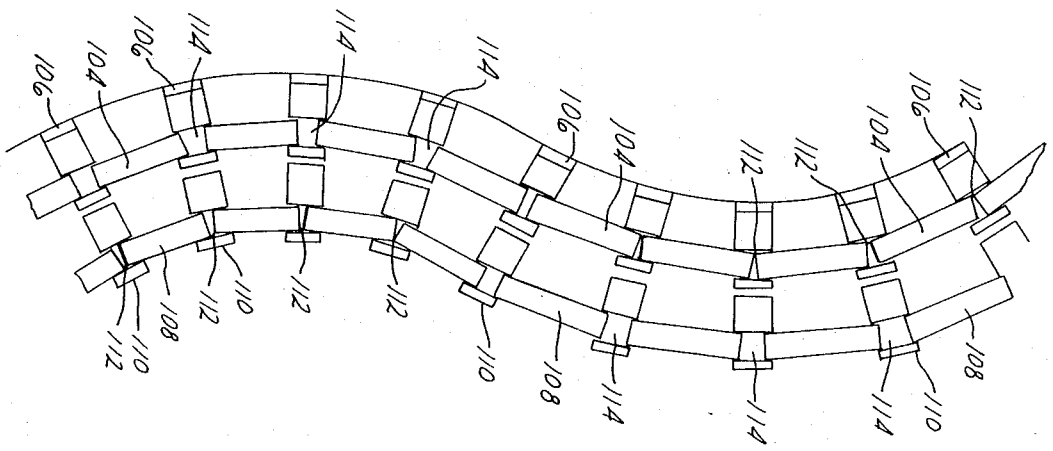
FIG. 15 is a schematic top view of two courses of a curved retaining-wall system built from blocks and beam of the type shown in FIGS. 1 through 4.

FIG. 15 depicts two courses of a curved retaining wall constructed from the described blocks and beams. These represent the upper and lower courses, for example, rather than adjacent courses. In the lower course, beams 104 extend between blocks 106. In the upper course, beams 108 extend between blocks 110. As illustrated in FIG. 15, the spacing between beams in different courses varies due to the fact that the beams are stepped back from each other, resulting in a different arc length between blocks. To accommodate this difference in arc length, it is desirable to bring the ends of adjacent beams on the inside of the curvature, designated 114, as closely together as possible, namely, in abutment with each other. This permits the ends of the beams on the outside of the curvature designated 114 to remain within the beam-receiving cavities of the blocks. In order to permit the beams on the inside of the curvature to abut each other, the stepped ends (51) of the beams must be longer than one-half the distance between the side faces of the blocks because the stepped ends of the beams do not enter the beam-receiving cavities squarely but, rather, slanted at an angle to the cavity axis. It should be noted that this also requires that the beams be sufficiently narrower than the beam-receiving cavities to permit the desired angle of slant.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, other double interlocking arrangements with curves rather than sharp angles between the interlocking surfaces can be employed to produce some aspects of the invention. Although the different features of the described walls are preferably all employed together as illustrated, they could be used separately in wall designs, depending on the circumstances. Further, interlocking of beams and blocks can be accomplished alternatively by providing beam-receiving cavities through the middle of the blocks as with cavity 38.

What is claimed is:

1. A building block made of concrete or the like comprising a front face, a back face, a top face, a bottom face, and a pair of side faces; the top face having a convex first surface comprising first and second planar surfaces with an obtuse convex vertex between the first and second planar surfaces extending between the side faces and a concave second surface comprising the second planar surface and a third planar surface with an obtuse concave vertex between the second and third planar surfaces extending between the side faces, the concave second surface lying between the convex first surface and the front face; the bottom face having a concave third surface comprising fourth and fifth planar surfaces with an obtuse concave vertex between the fourth and fifth planar surfaces extending between the side faces, and a convex fourth surface comprising the fifth planar surface and a sixth planar surface with an obtuse convex vertex between the fifth and sixth planar surfaces extending between the side faces, the convex fourth surface lying between the concave third surface and the front face, the convexity of the first and fourth surfaces matching the concavity of the third and second surfaces, respectively, wherein the concave second surface on the top face of the block has a smaller included angle than the convex first surface on the top face, so that the first and third planar surfaces coverge toward the front face of the block and wherein the convex third surface on the bottom face of the block has a larger included angle than the concave fourth surface on the bottom face of the block so that the fourth and sixth planar surfaces coverge toward the front face of the block at the same angle as the first and third planar surfaces converge.

2. The building block of claim 1, in which the front face and back faces converge toward the bottom face.

3. A building block having front and back faces, a pair of substantially parallel side faces and two matching faces perpendicular to the side faces and transverse to the front and back faces, each matching face comprising, seriatim, a first flat surface, a second flat surface angled relative to the first surface, and a third flat surface angled relative to the second surface at a different angle than between the first and second surfaces, said first surfaces on the matching faces being parallel, said third surfaces on the matching faces being parallel, and said second surfaces on the matching faces being parallel and extending the same distance between the first and third surfaces wherein the angle between the first and second surfaces on one face of the block is concave, the angle between the second and third faces is convex, and the included angle of the concave angle is smaller than the included angle of the convex angle for preventing a second like block having a matching face engaging a face of the first block from shifting out of engagement in the direction of either the front or back faces.

4. The building block of claim 3 further comprising a rectangular recess in each third surface of the matching faces for receiving the end of a beam between stacked blocks, the bottom of each recess being parallel to the third surfaces.

5. A building block made of concrete or the like having a front face, a back face, a top face, a bottom face and a pair of substantially parallel side faces, the top and bottom faces each including three approximately flat surfaces extending substantially perpendicular to said side faces comprising a front surface, a medial surface and a back surface, the front surface and medial surface being angled at a relatively smaller included angle for forming a concave vertex on the top face and a convex vertex on the bottom face, and the medial surface and back surface being angled at a relatively larger included angle for forming a convex vertex on the top face and a concave vertex on the bottom face, said surfaces and vertexes matching on the top and bottom faces for inhibiting sliding between adjacent blocks in the direction of either the front or back face.

6. The building block of claim 5 wherein the medial surfaces and back surfaces are each larger then the front surfaces.

7. The building block of claim 6 wherein each back surface includes a rectangular recess having a bottom parallel to the back surface.

8. A combination for assembling a mortarless retaining wall comprising:

a plurality of concrete blocks, each block comprising:
- a pair of parallel side faces,
- a back face perpendicular to the side faces,
- a front face perpendicular to the side faces,
- a non-planar top face perpendicular to the side faces, the top face having a shallow Z shape of three substantially flat surfaces,
- a non-planar bottom face perpendicular to the side faces, the bottom face having a shallow Z shape of three substantially flat surfaces sufficiently complementary to the top face for stacking snugly on top of a similar block, the Z shape on each of the top and bottom faces being sufficiently assymetrical for inhibiting slippage between such top and bottom faces in the direction of either the front or back face,
- a rectangular recess in the top face extending btween the side faces, and
- a rectangular recess extending between the side faces at a location in the bottom face for cooperating with a rectangular recess in the top face of a corresponding block when such blocks are stacked for forming a rectangular passage between the side faces of such blocks; and a plurality of elongated concrete beams, each beam comprising:
- a central portion having a cross section larger than the cross section of such a passage, and
- a step portion at each end having a rectangular cross section sufficiently smaller than such a passage for fitting into such a passage.

9. A combination as recited in claim 8 wherein the central portion of each beam has a height less than the height of such a block between the top and bottom faces.

10. A combination as recited in claim 8 wherein the central portion of each beam has a height about the same as the height of such a block between the top and bottom faces.

11. A combination as recited in claim 8 wherein the length of the step portion at each end of the beam has a length of about one half the thickness of such a block between the side faces.

12. A combination as recited in claim 8 wherein the rectangular recesses have sides that are parallel to the back face of such a block.

13. A combination as recited in claim 12 wherein the included angle between a first and a second of the flat surfaces is less than the included angle between the second and a third of the flat surfaces on the top of the block for inhibiting slippage between the bottom face of one block and the top face of an adjacent block in a direction toward the front of such blocks.

14. A wall made of concrete or the like comprising a plurality of upright spaced-apart columns each formed by a plurality of blocks stacked one on top of the other, and a plurality of beams extending between each pair of adjacent columns such that the ends of the beams are held between the respective blocks of the columns, the wall being characterized in that at least part of the top and bottom faces of the blocks are non-planar and contoured in complementary fashion so abutting blocks forming each column are interlocked without mortar between the blocks for inhibiting sliding between adjacent blocks in the direction of either the front or back of the wall, wherein the blocks each comprise a front face, a back face, and a pair of side faces; the top face has a convex angular first surface with a vertex extending between the side faces and a relatively larger included angle, and a concave angular second surface with a vertex extending between the side faces and a relatively smaller included angle, the concave second surface being between the convex first surface and the front face; the bottom face has a concave angular third surface with a vertex extending between the side faces, and a convex angular fourth surface with a vertex extending between the side faces, the convexity of the first and fourth surfaces matching the concavity of the third and second surfaces, respectively.

15. The wall of claim 14 which the first, second, third and fourth surfaces all form obtuse angles.

16. The wall of claim 14 in which rectangular recesses are formed in the top and bottom faces between the side faces, the recesses having side walls that are aligned with each other and parallel to the back face, so abutting top and bottom faces form cavities that receive the ends of the beams.

17. The wall of claim 16 in which the front face is planar, the angular first surface comprises a rearward planar fifth surface and a medial planar sixth surface; the angular second surface comprises the planar sixth surface and a forward planar seventh surface; the angular third surface comprises a rearward planar eighth surface and a medial planar ninth surface; and the angular fourth surface comprises the planar ninth surface and a forward planar tenth surface.

18. The wall of claim 17 in which the planar fifth and eighth surfaces are approximately parallel to each other, the planar sixth and ninth surfaces are approximately parallel to each other, and the planar seventh and tenth surfaces are approximately parallel to each other.

19. The wall of claim 18 additionally comprising a cavity extending through the block from side to side between the side faces, the cavity having planar top and bottom surfaces parallel to the planar sixth and ninth surfaces.

20. The wall of claim 14 in which the bottom block of each column has a planar bottom face, the wall additionally comprising a horizontal slab of concrete or the like cast in engagement with the bottom blocks of the columns.

21. The wall of claim 20 additionally comprising a vertical leg integral with the slab and extending downwardly therefrom.

22. The wall of claim 20 additionally comprising a plurality of reinforcing bars integral with the slab, the plurality of reinforcing bars including a pair of reinforcing bars extending along the wall in front of the columns and behind the columns approximately parallel to the beams and transverse reinforcing bars between the respective columns.

23. The wall of claim 14 in which the bottom block of each column has a planar horizontal bottom face and a front face, the wall additionally comprising a slab of concrete or the like abutting the front face of the bottom block.

24. The wall of claim 23 in which the slab is vertically oriented.

25. The wall of claim 23 in which the slab is horizontally oriented.

26. The wall of claim 14 in which the bottom block of each column has a flat horizontal bottom face and a front face, the wall additionally comprising a horizontal slab underlying the bottom face, the slab having a lip against which the front face of the bottom block bears.

27. The combination of claim 8, additionally comprising one or more concrete base blocks, each comprising:

a pair of parallel side faces, a back face perpendicular to the side faces, a front face perpendicular to the side faces, a nonplanar top face perpendicular to the side faces, and a planar bottom face extending between the front face and the back face.

28. The wall of claim 14, in which the plurality of columns each additionally comprise a base block under the plurality of blocks, the base block having a top face contoured in complementary fashion to the abutting overlying block to interlock therewith and having a flat bottom face.

* * * * *